United States Patent [19]

Perosino

[11] Patent Number: 4,684,324

[45] Date of Patent: Aug. 4, 1987

[54] AXIAL FAN, PARTICULARLY FOR MOTOR VEHICLES

[75] Inventor: Alessandro Perosino, Turin, Italy

[73] Assignee: Gate S.p.A., Asti, Italy

[21] Appl. No.: 858,331

[22] Filed: May 1, 1986

[30] Foreign Application Priority Data

Aug. 2, 1985 [IT] Italy ..... 53676/85

[51] Int. Cl.[4] ..... F04D 29/38

[52] U.S. Cl. ..... 416/189; 416/238; 416/DIG. 2; 415/119

[58] Field of Search ..... 416/189 R, 238, 195, 416/228, DIG. 5, DIG. 2; 415/119

[56] References Cited

U.S. PATENT DOCUMENTS

| | | | |
|---|---|---|---|
| 1,542,853 | 6/1925 | Callahan | 416/189 R |
| 2,639,886 | 5/1953 | Townhill et al. | 416/189 R |
| 2,903,076 | 9/1959 | Johannesen | 416/189 R |
| 3,998,567 | 12/1976 | Fried | 416/189 R |
| 4,358,245 | 11/1982 | Gray | 416/189 |
| 4,563,622 | 1/1986 | Deavers et al. | 416/189 R |
| 4,569,631 | 2/1986 | Gray III | 416/189 |

FOREIGN PATENT DOCUMENTS 10252 of 1911 United Kingdom ..... 416/189 R

OTHER PUBLICATIONS

Report entitled "Some Advances in Design Techniques for Low Noise Operation of Propellers and Fans", Portion of Noise Con 77 Proceedings, published by the NASA Langley Research Center of Hampton Va., Oct. 1977.

*Primary Examiner*—Robert E. Garrett
*Assistant Examiner*—John Kwon
*Attorney, Agent, or Firm*—Robert P. Hayter

[57] ABSTRACT

An axial fan in which the median line (B) of each blade (3) has a first radially-innermost, rearwardly-directed curved portion ($B_1$) and a second radially-outermost, forwardly-directed curved portion ($B_2$), the former portion being between 25% and 50% of the full radial extent of the blade. The profile of the blade is characterized in that its circular thickness (S) increases progressively from the interior to the exterior, and the pitch setting angle (W) of the profile decreases progressively from the interior to the exterior.

2 Claims, 4 Drawing Figures

AXIAL FAN, PARTICULARLY FOR MOTOR VEHICLES

The present invention relates to axial fans for operating particularly quietly in the presence of a turbulent air flow. More particularly, the invention is concerned with axial fans for operating in combination with motor vehicle radiators, of the type comprising a central hub, a plurality of blades which extend from the hub towards the periphery and the radially outermost parts of which are curved forwardly in the sense of rotation of the fan, and an outer coaxial ring having an inner cylindrical surface to which the peripheral ends of the blades are fixed.

The forward curvature of the blades is generally intended to enable silent operation and, according to the prior art, in order to obtain appreciable results from this point of view, each blade is normally given a very high forward curvature, as illustrated, for example, in U.S. Pat. No. 4,358,245. In this patent, the angular extent of the median line of a blade is specified to be greater than half the angular distance between two adjacent blades.

In these conditions, a blade with such a curvature is extremely long and suffers several disadvantages. In the first place, other conditions being equal, a greater amount of material is needed to make the blade and the fan therefore has a greater weight. In the second place, the increased length of the blade results in a lowering of the vibrational frequency of the blade itself, which means that the blade is more unstable and may therefore have a poor performance and may not be so quiet. This fact may make it necessary to limit the speed of rotation the fan in use, thereby reducing its performance.

The object of the present invention is to provide a fan of the type specified above which does not have the aforesaid disadvantages even at relatively high speeds of rotation, and which thus has a good performance and is very quiet in these conditions.

In order to achieve this object, the present invention provides an axial fan of the type specified above, characterised in that the median line of each blade which is obtained by joining the points that are circumferentially equidistant from the leading edge and the trailing edge of the blade in the axial projection of the blade profile, has a first, radially-innermost curved portion which extends from its point of origin on the hub and is directed rearwardly of the radial line passing through the point of origin itself, and a second, radially-outermost curved portion joined to the first portion and extending forwardly of the radial line to the periphery connected to the outer coaxial ring of the fan, the radial extent of the first portion being between 25% and 50% of the overall radial extent of the blade defined by the radial line between the periphery of the hub and the inner cylindrical surface of the outer coaxial ring.

The noise of a fan is generally influenced particularly by the radially outermost portions of its blades where the peripheral rotational speed of the blade is highest.

The blade conformation of the fan according to the invention has a relatively more-forwardly-curved outer portion and thus ensures silent operation.

However, the inner portion of the blade, which is also curved so as to be joined with the outer portion, is behind the radius through the point of origin of the median line of the blade itself.

The invention will now be described with reference to a practical embodiment given by way of non-limiting example and illustrated in the appended drawings, in which.

Figure 2:
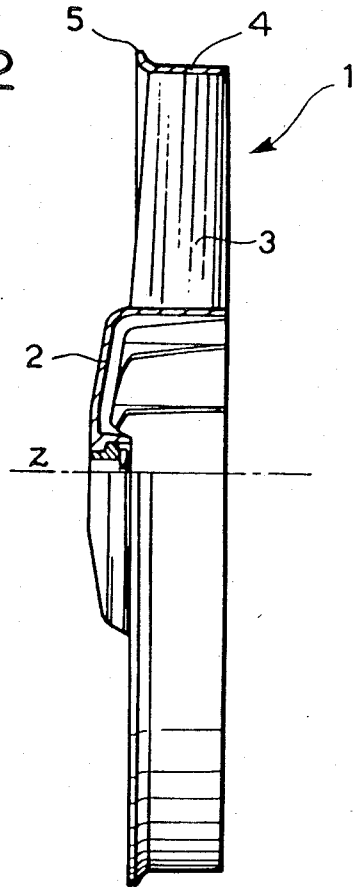
FIG. 2 is a partially sectioned lateral view on the arrow II on FIG. 1.
Figure 1:
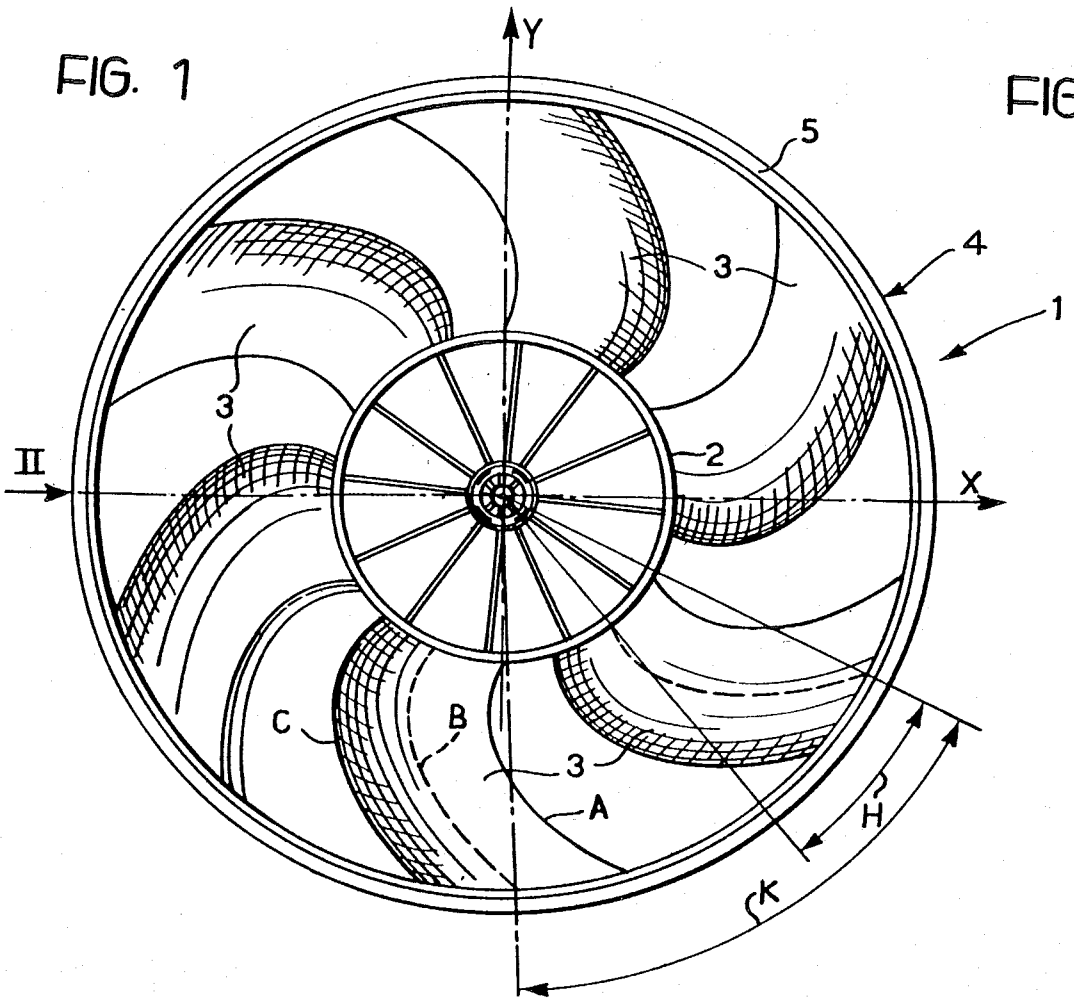
FIG. 1 is a front elevational view of a fan according to the invention.
Figure 3:
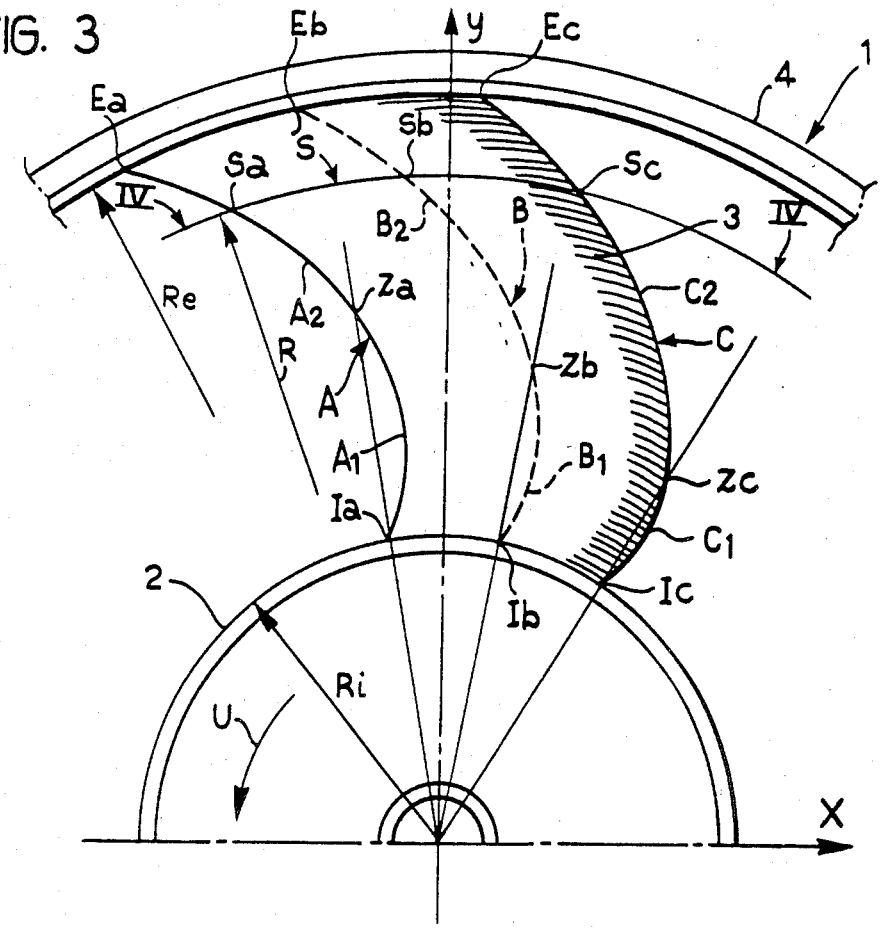
FIG. 3 is a view of a part of FIG. 1 on an enlarged scale.

A fan unit, generally indicated 1, is constituted by a central hub 2, a plurality of intermediate blades 3 and an outer cylindrical ring 4. Each blade 3 extends from its section of origin on the outer cylindrical surface of the hub 2, which has a radius $R_i$, and curves forwardly relative to the sense of rotation U of the fan until it is connected at its exterior to the inner cylindrical surface of the ring 4, which has a radius $R_e$. In the frontal views of FIGS. 1 and 3, each blade 3 is delimited by a line A which constitutes the frontal projection of the leading edge of the blade itself and a line C which constitutes the frontal projection of the trailing edge of the blade.

An intermediate line B is drawn as a broken line between the two lines A and C. Any circumference is indicated by the letter R and the circular thickness of the blade on the circumference R is indicated S. The thickness S is thus the arc of the circumference R between the points $S_a$ and $S_c$ where the circumference R intersects the lines A and C respectively. The midpoint of the arc S is indicated $S_b$. If the value of the radius of the circumference R is changed and all the points $S_b$ thus obtained are joined, the said median line B is determined. The median line B starts from the point $I_b$ on the hub and ends at the point $E_b$ on the outer ring 4. If the radial line passing through the point $I_b$ is described, this line intersects the line B at a point indicated $Z_b$. The median line B thus includes a first inner portion $B_1$ which is behind the radial line and a second outer portion $B_2$ which is in front of the radial line. A similar development also characterises the leading line A and the trailing line C. The leading line A starts at a point $I_a$ and ends at a point $E_a$. The radial line passing through the point $I_a$ intersects the leading line A at a point $Z_a$ whereby the line A is divided, relative to the radial line, into a first rearward portion $A_1$ and second forward portion $A_2$. Similarly, the trailing line C has the points $I_c$, $E_c$, $Z_c$, and consequently the line C is also divided into a rearward portion $C_1$ and an forward portion $C_2$. The radial distance between the points $I_b$ and $Z_b$ is normally between 25% and 50% of the radial distance between the outer surface of the hub 2 of radius $R_i$ and the inner surface of the outer ring 4 of radius $R_e$. The circular thickness S increases progressively from the interior to the exterior.

Figure 4:
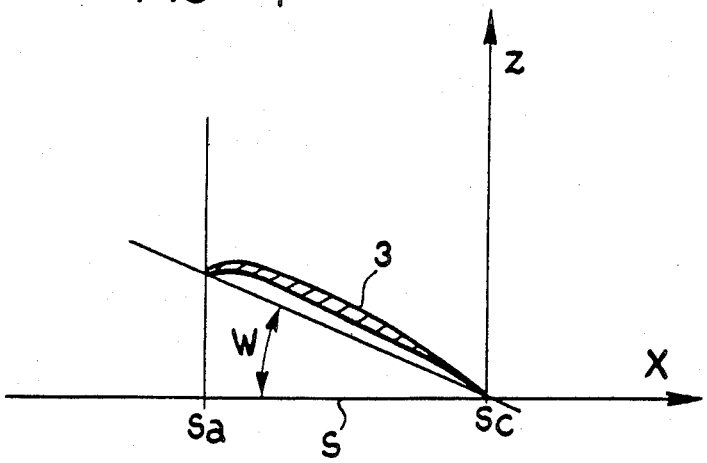
FIG. 4 is a section taken on the circular line IV—IV of FIG. 3 and developed on a plane.

In FIG. 4 the angle of attack of the blade in the section in question is indicated W. The value of the angle W decreases progressively with an increase in radius from the radius $R_i$ on the hub to the radius $R_e$ on the inner surface of the ring 4. If the two radial lines passing through the points $I_b$ and $E_b$ of the same blade 3 are described, an angular interval H is obtained. If the radial lines passing through the points $E_b$ of two adjacent blades are considered, however, the angular distance between two consecutive blades, indicated K, is identified. The interval H is always less than or equal to the distance K.

EXAMPLE

An axial fan for operating in combination with a motor vehicle radiator is made according to the present invention with the following characteristics:

| | |
|---|---|
| Outer diameter of the blade | 305 mm |
| Inner diameter | 125 mm |
| Number of blades | 6 |
| Pitch setting angle of the blades in correspondence with the outer diameter | 19.38° |
| Pitch setting angle of the blades in correspondence with the inner diameter | 36.75° |
| Circular thickness of the blades in correspondence with the outer diameter | 75.5 mm |
| Circular thickness of the vanes in correspondence with the inner diameter | 46.5 mm |

This fan supplies an air flow of 2000 $m^3$ per hour at an operating speed of 2840 revolutions per minute and an absorbed power of 150 watts.

The noise measured with a microphone placed on the axis 2 meters from the fan is 66 dbA in the case of use in association with a motor vehicle radiator and 64 dbA in the absence of a radiator.

I claim:

1. Axial fan, particularly for motor vehicles, comprising a central hub, a plurality of blades which extend from the hub towards the periphery and the radially outermost parts of which are curved forwardly in the sense of rotation of the fan, and an outer coaxial ring having an inner cylindrical surface to which the peripheral ends of the blades are fixed, characterised in that the median line (B) of each blade (3), which is obtained by joining the points ($S_b$) that are circumferentially equidistant from the leading edge (A) and the trailing edge (C) of the blade in the axial projection of the blade profile, has a first, radially-innermost curved portion ($B_1$) which extends from its point of origin ($I_b$) on the hub (2) and is directed rearwardly of the radial line ($I_b$, $Z_b$) passing through the point of origin itself, and a second, radially-outermost curved portion ($B_2$) joined to the first portion and extending forwardly of the radial line to the periphery ($E_b$) connected to the outer coaxial ring (4) of the fan, the radial extent of the first portion being between 25% and 50% of the overall radial extent of the blade defined by the radial distance between the periphery ($R_i$) of the hub (2) and the inner cylindrical surface ($R_e$) of the outer coaxial ring (4) and further characterised in that the median line (B), from its point of origin ($I_b$) on the hub to its end point ($E_b$) on the outer ring, is within an angular interval no greater than half the distance between two adjacent blades, the profile of the blade also being characterised in that its circular thickness increases progressively from the interior to the exterior and in that the pitch setting angle of the profile decreases progressively from the interior to the exterior.

2. Fan according to claim 1, characterised in that the curves obtained by the axial projection of the leading edge (A) and the trailing edge (C) of the blade (3) both have, with respect to the corresponding radial line passing through the respective point of origin of each curve on the central hub, a first inner portion ($A_1$, $C_1$) which is to the rear and a second outermost portion ($A_2$, $C_2$) which is in front.

* * * * *